US005105175A

United States Patent [19]

Kaltenecker

[11] Patent Number: 5,105,175

[45] Date of Patent: Apr. 14, 1992

[54] RESONANT CIRCUIT ELEMENT HAVING INSIGNIFICANT MICROPHONIC EFFECTS

[75] Inventor: Robert S. Kaltenecker, Mesa, Ariz.

[73] Assignee: Motorola, Inc., Schaumburg, Ill.

[21] Appl. No.: 667,936

[22] Filed: Mar. 12, 1991

[51] Int. Cl.[5] ..... H01P 7/00

[52] U.S. Cl. ..... 333/219; 333/235

[58] Field of Search ..... 333/204, 205, 219, 235, 333/246

[56] References Cited

U.S. PATENT DOCUMENTS

| | | | |
|---|---|---|---|
| 4,620,168 | 10/1986 | Delestre et al. | 333/235 |
| 4,785,271 | 11/1988 | Higgins, Jr. | 333/204 |
| 4,816,788 | 3/1989 | Ishikawa et al. | 333/204 |
| 4,916,417 | 4/1990 | Ishikawa et al. | 333/204 |
| 4,940,955 | 7/1990 | Higgins, Jr. | 333/204 |

*Primary Examiner*—Eugene R. LaRoche

*Assistant Examiner*—Evelyn A. Lester

*Attorney, Agent, or Firm*—Joe E. Barbee

[57] ABSTRACT

A rigid, monolithic structure for the resonator elements of a tuned stripline segment which may be adjusted by simple, low cost techniques. The resonator elements use a stripline segment (23,24) made from conductive layers of a multilayer printed circuit board. This structure allows the stripline segment to be totally enclosed in a solid, incompressible dielectric material (15,17) which is essentially immune to microphonic effects. A plurality of shorting holes (21) are fabricated at one end of the stripline which serve to short circuit the stripline segment (23) to the ground conductors (18,19) on the layers above and below the stripline segment (23). Adjustment of the resonant frequency is accomplished by removing the plated conductor inside one of the holes at a time, thus removing the short, until the desired resonant frequency is obtained.

5 Claims, 2 Drawing Sheets

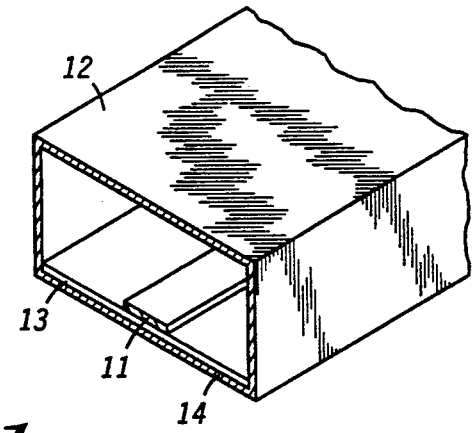
FIG. 1
-PRIOR ART-
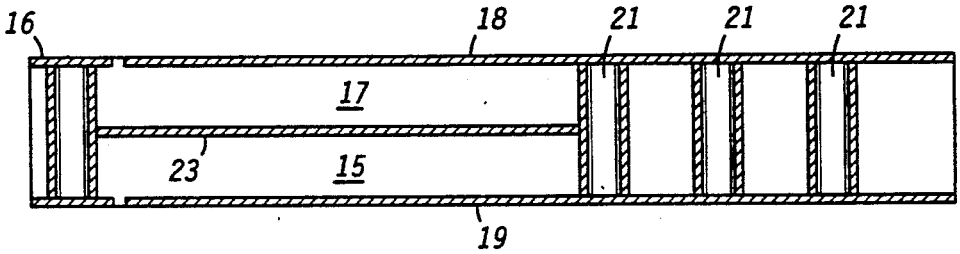
FIG. 2
FIG. 3
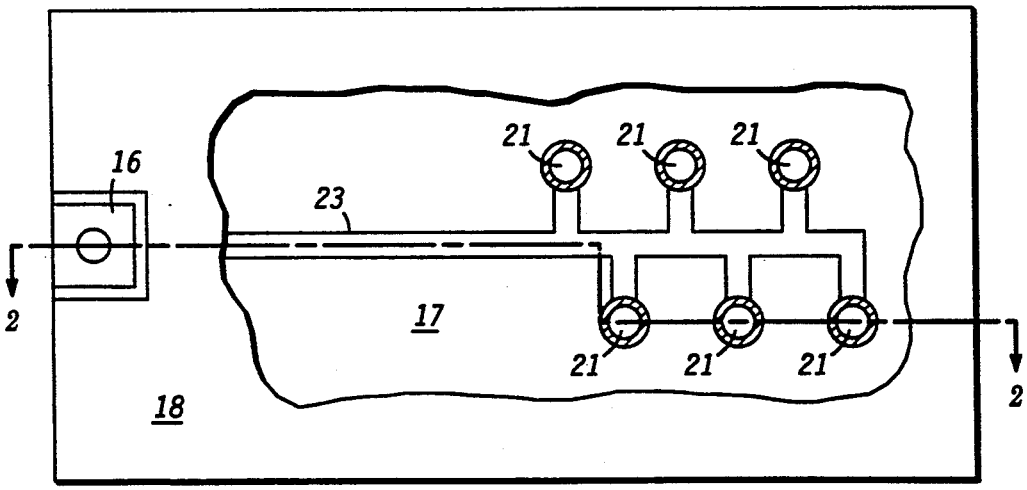

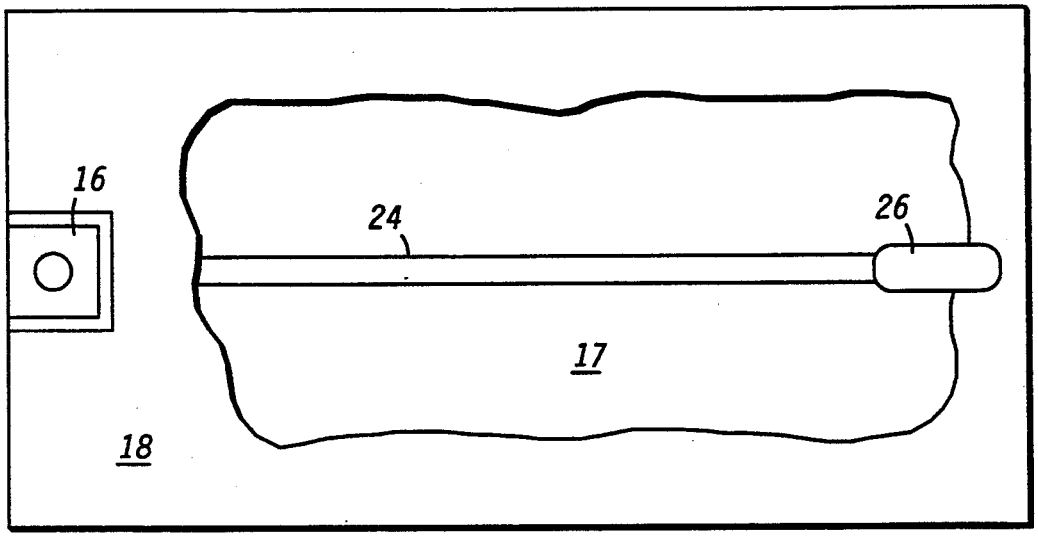
FIG. 4
FIG. 5
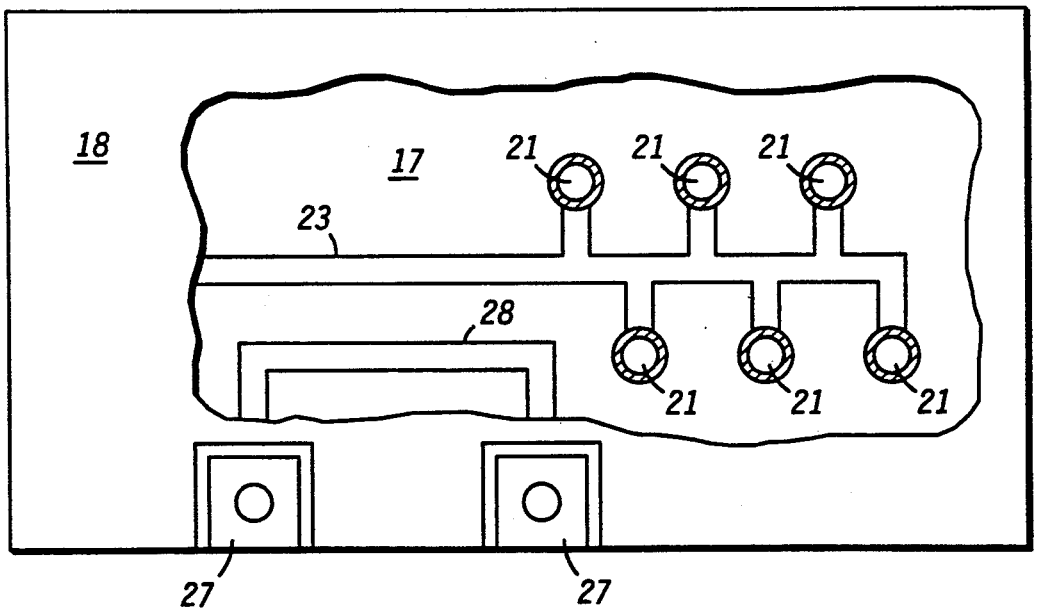

RESONANT CIRCUIT ELEMENT HAVING INSIGNIFICANT MICROPHONIC EFFECTS

BACKGROUND OF THE INVENTION

The present invention relates, in general, to minimizing the effect of mechanical vibration on the frequency of a resonant circuit element, and more particularly to a circuit element which is constructed such that the effect of mechanical vibration is minimized but still has a capability for mechanical adjustment of resonant frequency after manufacture.

Electrically resonant tuned circuits have long been used in the generation, amplification, and filtering of high frequency signals for radio, digital and analog applications. Even small changes in the resonant frequency of the circuit often have undesirable side effects, particularly if the resonator is used to determine the frequency of an oscillator. One of the principal sources of short term changes in resonant frequency stems from a microphonic effect due to mechanical vibration of the resonant circuit. Typically this microphonic effect is caused by a lack of rigidity between the circuit elements which make up the resonant circuit. While this microphonic effect can be reduced by proper design, the need for a mechanical adjustment to compensate for manufacturing variation and the physical form of the resonator limits the rigidity that can be achieved.

Resonant circuits designed to operate at frequencies over approximately 50 Mhz often take the form of a resonant transmission line segment. Fine tuning adjustment is typically accomplished by means of a capacitor coupled to the input end of the transmission line segment. This capacitance has the effect of lowering the resonant frequency by an amount which depends on the value of the capacitor. Thus adjustment of the capacitance has the effect of adjusting the resonant frequency of the resonant transmission line. The mechanical design of this adjustable capacitor combined with the requirements of mounting the capacitor and coupling it to the resonant line all serve to limit the rigidity of the structure. Another problem is the effect of the shielded enclosure for the resonator, this enclosure will couple any mechanical vibration in the structure to the resonant circuit, once again causing a microphonic effect. Clearly there is a need for a more rigid structure for resonant circuit elements such that the effects of vibration and shock are minimized.

SUMMARY OF THE INVENTION

Briefly stated, the present invention provides a monolithic structure for the frequency determining elements of a transmission line resonator. The transmission line resonator uses a stripline segment made from conductive layers of a multilayer printed circuit board, with ground plane layers both above and below the stripline segment. The stripline segment is thus totally enclosed in a solid, rigid and incompressible dielectric material and is essentially immune to vibration effects. A plurality of shorting holes are fabricated at one end of the stripline which serve to short circuit the line to the ground plane layers above and below the stripline segment. Adjustment of the resonant frequency is accomplished by removal of the plated conductor material inside the holes one at a time until the desired resonant frequency is obtained. Typically this removal is accomplished by enlarging the hole with a drill. This invention provides a rigid, monolithic structure for the resonator elements which may be adjusted by simple, low cost techniques.

BRIEF DESCRIPTION OF THE DRAWINGS

FIG. 1 shows an isometric view of a shielded microstrip resonator element typical of the prior art;

FIG. 2 shows a cross section view of a non-microphonic stripline resonator according to the present invention;

FIG. 3 shows a top view of the non-microphonic stripline resonator shown in FIG. 2;

FIG. 4 shows a top view of an alternative embodiment of a non-microphonic stripline resonator according to the present invention; and FIG. 5 shows a top view of another embodiment of a non-microphonic stripline resonator according to the present invention.

DETAILED DESCRIPTION OF THE DRAWINGS

FIG. 1 shows an isometric view of a shielded microstrip resonator element typical of the prior art. A conductive strip 11 forms a microstrip segment with a ground plane layer 14 separated by a dielectric layer 13. Conductive strip 11 is connected to ground plane layer 14 at a predetermined distance from the input end to form a resonant stub. A plurality of shields 12 surround the top and sides of the resonator element so as to isolate conductive strip 11 from undesired coupling to any other components. An external capacitor (not shown) is used to compensate for manufacturing variation by adjusting the resonant frequency of conductive strip 11. In most ways this tuned stub provides an excellent resonator element for frequencies greater than about 50 Mhz, however any shock or vibration which causes shields 12 to move with respect to conductive strip 11 will change the resonant frequency of the resonator element. When this resonator element is used to control the frequency of an oscillator circuit the result is a frequency modulation of the generated signal. There is a need for a resonator element which is easily built, can be adjusted to compensate for manufacturing variations, but is sufficiently rigid to eliminate the microphonic effect.

FIG. 2 shows a cross section view of a non-microphonic stripline resonator as a preferred embodiment of the present invention. The stripline resonator is fabricated from a section of a multilayer printed circuit board, comprising an upper ground plane layer 18, an upper solid dielectric layer 17, a center conductor 23, a lower solid dielectric layer 15 and a lower ground plane layer 19. Upper ground plane layer 18 and lower ground plane layer 19 are conductive layers which are coupled to an electrical ground potential so as to provide a shield for center conductor 23. Upper solid dielectric layer 17 and lower solid dielectric layer 15 are fabricated from a solid, rigid, and incompressible dielectric material. Center conductor 23, completely buried inside the multilayer printed circuit board, is constructed to provide a resonant stripline segment of a predetermined resonant frequency when shorted by a plurality of shorting holes 21. Shorting holes 21 are holes through the printed circuit board material having an inner surface plated with a conductive material. Shorting holes 21 serve to short circuit center conductor 23 to upper ground plane layer 18 and lower ground plane layer 19, thus making a resonant stripline segment terminated by a short circuit. A connecting pad 16, comprising a pad and a plated hole which connects the pad to one end of center conductor 23 and is used to couple center conductor 23 to other circuit components. Connecting pad 16 represents the input to this stripline resonator, and is shown as a surface connection for clarity.

Removing the conductive plating from the shorting hole 21 closest to connecting pad 16 will increase the length of center conductor 23 lowering the resonant frequency of the resonant stripline segment. Thus shorting holes 21 provide a means to adjust the resonant frequency of this stripline resonator without requiring external components. Removal of the conductive plating from shorting holes 21 is typically accomplished by redrilling the selected hole 21 with a drill bit that is slightly larger than the original hole. This eliminates the electrical connection between the selected hole 21 and the ground plane.

FIG. 3 shows a cut away top view of the non-microphonic stripline resonator as a preferred embodiment of the present invention, a cross section view of which was shown in FIG. 2. Upper ground plane layer 18 covers the entire printed circuit board except for the area occupied by connecting pad 16. An area is illustrated as cut away to show the underlying center conductor 23. Center conductor 23 and upper ground plane layer 18 are separated by upper solid dielectric layer 17 as shown in FIG. 2. Center conductor 23 can be seen to comprise a narrow strip of conductive material which joins connecting pad 16 to shorting holes 21. In this embodiment of the present invention, shorting holes 21 are arranged on either side of center conductor 23 so as to allow a closer spacing of shorting holes 21, providing a fine adjustment capability. Alternative embodiments of this invention vary the number of shorting holes 21 and the amount of extra length provided by removal of plating from each hole according to the adjustment desired.

FIG. 4 shows a top view of an alternative embodiment of a non-microphonic stripline resonator according to the present invention. Upper ground plane layer 18 covers the entire printed circuit board except for the area occupied by connecting pad 16. An area is illustrated as cut away to show an underlying center conductor 24. Center conductor 24 and upper ground plane layer 18 are separated by upper solid dielectric layer 17 as before. Center conductor 24 can be seen to comprise a narrow strip of conductive material which joins connecting pad 16 on one end and is open circuited on the other end. Center conductor 24 forms a resonant stripline segment terminated by an open circuit. Adjustment of the resonant frequency of center conductor 24 is accomplished by selective removal of material from the open end center conductor 24. Typically this is accomplished by drilling out of all of the material of the printed circuit board at this point, leaving a slot 26 which passes completely through the printed circuit board. Shortening central conductor 24 in this way raises its resonant frequency. It should be clear that many variations of the shape and size of slot 26 resulting from removal of material from center conductor 24 are possible as alternative embodiments of this invention.

FIG. 5 shows a top view of another embodiment of a non-microphonic stripline resonator according to the present invention. Upper ground plane layer 18, upper solid dielectric layer 17, center conductor 23, connecting pad 16 and shorting holes 21 are as shown in FIG. 2 and FIG. 3 above. A conductive strip 28 is inductively coupled to center conductor 23. A plurality of connecting pads 27 serve to couple conductive strip 28 to other circuit components. As a result, conductive strip 28 serves to couple the non-microphonic stripline resonator to the external circuit components. Alternative embodiments of this invention include grounding of one end of conductive strip 28 and coupling of conductive strip 28 to center conductor 23 by capacitive coupling rather than by inductive coupling.

By now it should be apparent that the present invention provides a stripline resonator in which all frequency determining elements, including frequency adjusting means, are buried in a rigid support of a solid, incompressible dielectric material. A simple, low cost method is provided to adjust the resonant frequency so as to compensate for manufacturing variations. The result is a resonator that is essentially immune to the problem of microphonic effects.

I claim:

1. A resonant circuit element having insignificant microphonic effects, comprising:

a center conductor fabricated from a multilayer printed circuit board;

a first ground plane positioned above the center conductor;

a second ground plane positioned below the center conductor;

a plurality of rigid and incompressible dielectric layers which separate the center conductor from the ground planes in such a way as to form a resonant stripline segment held rigidly in place relative to the first and second ground planes; and a plurality of shorting holes located at one end of the center conductor, which extend perpendicular to the center conductor through the printed circuit board and further connects said first and second ground plane, in which conductive shorting material is selectively removed to provide a trimming adjustment of the resonant frequency of the transmission line segment.

2. The resonant circuit element having insignificant microphonic effects of claim 1 further comprising an additional conductive strip which is separated from the center conductor and which is formed in such a way as to couple electrical energy between external circuit elements and the resonant circuit element having insignificant microphonic effects.

3. A resonant circuit element having insignificant microphonic effects, comprising:

a first and a second ground plane positioned above and below a center conductor wherein the center conductor forms a resonant stripline segment which is completely buried within a solid dielectric; and a plurality of shorting holes located at one end of the center conductor, which extend perpendicular to the center conductor through the printed circuit board and further connects said first and second ground plane, in which conductor material is selectively removed to provide a trimming adjustment of the resonant frequency of the resonant stripline segment.

4. A resonant circuit element having insignificant microphonic effects, comprising:

a center conductor fabricated within a multilayer printed circuit board to form an open circuit resonant stripline segment and wherein the conductive material of the center conductor is selectively removed so as to adjust the resonant frequency of the open circuit resonant stripline segment;

a first ground plane positioned above the center conductor;

a second ground plane positioned below the center conductor; and a plurality of solid dielectric layers which separate the center conductor from the first and second ground planes in such a way as to form a resonant stripline segment which is completely enclosed within the printed circuit board by the solid dielectric layers and the ground planes and furthermore the center conductor is held rigidly in position relative to the ground planes by the solid dielectric.

5. A method to minimize microphonic effects in a resonant circuit element, comprising:

forming a center conductor on a multilayer printed circuit board;

positioning a first ground plane above the center conductor;

positioning a second ground plane below the center conductor;

separating the center conductor from the conductive ground plane layers by means of a plurality of solid dielectric layers in such a way as to form a resonant stripline segment which is completely buried within the printed circuit board;

providing a plurality of shorting holes located at one end of the center conductor, which extend perpendicular to the center conductor through the printed circuit board and further connects said first and second ground plane; and removing conductive material from selected shorting holes to adjust the resonant frequency of the transmission line segment.

* * * * *